United States Patent [19]

Sitta et al.

[11] Patent Number: 4,585,049

[45] Date of Patent: Apr. 29, 1986

[54] METHOD OF AND APPARATUS FOR HANDLING PERMANENT MOLDS

[75] Inventors: Jaroslav Sitta, Zabreh; Karll Kopka, Mohelnice; Frantisek Petrik, Mohelnice; Kvetoslav Vyjidacek, Mohelnice, all of Czechoslovakia

[73] Assignee: Mez Mohelnice narodni podnik, Mohelnice, Czechoslovakia

[21] Appl. No.: 435,607

[22] Filed: Oct. 20, 1982

Related U.S. Application Data

[63] Continuation of Ser. No. 078,711, Sep. 25, 1979, abandoned, which is a continuation of Ser. No. 915,204, Jun. 13, 1978, abandoned.

[30] Foreign Application Priority Data

Jun. 22, 1977 [CS] Czechoslovakia ..... 4113-77

[51] Int. Cl.[4] ..... B22D 5/04

[52] U.S. Cl. ..... 164/324; 164/330; 164/331

[58] Field of Search ..... 164/322, 323, 324, 329, 164/330, 331, 168; 198/339, 580, 795

[56] References Cited

U.S. PATENT DOCUMENTS

| | | | |
|---|---|---|---|
| 1,880,380 | 10/1932 | Frantz | 164/343 |
| 2,684,510 | 7/1954 | Muller | 164/343 |
| 3,340,926 | 9/1967 | Sylvester | 164/323 |
| 3,576,246 | 4/1971 | Hulet | 164/324 |
| 3,682,236 | 8/1972 | Becke | 164/324 |
| 3,955,613 | 5/1976 | Lund | 164/324 |

FOREIGN PATENT DOCUMENTS

| | | | |
|---|---|---|---|
| 0423287 | 12/1925 | Fed. Rep. of Germany | 164/324 |

*Primary Examiner*—Nicholas P. Godici
*Assistant Examiner*—Richard K. Seidel

[57] ABSTRACT

There is disclosed an apparatus wherein permanent molds for casting metals and the like, supported by carriers, proceed along a closed track comprising a forward path and a return path, thereby maintaining their original order. The carriers with molds are advanced along the forward path step-by-step with most operations then being performed. At the end of the forward path they are shifted sidewards to the return path where they are driven by a continuous drive toward the end of the return path, to be at this place again shifted sidewards to the start of the forward path. By changing the number of carriers in the return path, the conditions for cooling the molds are altered and thus castings of different size may be produced without changing the fundamental cycle of the apparatus.

14 Claims, 4 Drawing Figures

METHOD OF AND APPARATUS FOR HANDLING PERMANENT MOLDS

This application is a continuation of application Ser. No. 078,711, filed Sept. 25, 1979, now abandoned, which is a continuation of application Ser. No. 915,204, filed June 13, 1978, now abandoned.

The invention relates to a method of handling permanent molds for casting metals and the like, and to an arrangement for performing this method.

Handling of permanent molds has been hitherto carried out in arrangements for casting into permanent molds in that the permanent molds proceeded step-by-step along the entire track, which track has been fully occupied by carriers with permanent molds. Each of the casting arrangements actually employed enables castings of a definite weight category only to be made, and in a specific technological time sequence. A drawback of the arrangements actually employed is, however, that if fastings of a nearest higher weight category have to be made, it is necessary to prolong the technological cycle as the permanent mold requires a longer time for cooling and for its preparation for the following casting. This prolongation of the technological cycle of the permanent mold has a consequence of prolongation of the technological cycle of the whole casting arrangement; this is a substantial drawback, as the prolongation of the technological cycle means a reduction of the production capacity of the casting arrangement.

Arrangements actually used for casting into permanent molds either form a manufacturing line comprising a number of units, i.e., stationary machines, or rotary or carrousel and conveyor casting machines. A drawback of a manufacturing line composed of units is that each unit has to be provided with its own drive. Moreover, such a manufacturing line is rather complicated and expensive. It is impossible to automate the attendance of the arrangement, as it cannot be concentrated in a single place. A drawback of carrousel casting arrangements is the limitation that, in case the capacity of the arrangement has to be increased, this must be done by an increase of its diameter and number of working sites, resulting in an excessive weight of the carrousel. The drive at the center of the carrousel is complicated, and is thus liable to frequent failure of driving device of the permanent mold, or in case of a failure of the permanent mold, the whole carrousel has to be stopped to permit its exchange, thus resulting in substantial losses. A drawback of a conveyor casting line is its chain drive, which is not suitable for casting into permanent molds, as this kind of casting requires an automatic ejection of the castings. The driving mechanism of permanent molds adapted for automatic ejection cannot be engaged and disengaged in unstable positions (chain coupling) in order to eject the casting from the permenent mold; in addition, the driving mechanism of the permanent mold, provided with all necessary accessories, is heavy, bulky, and the handling of the mechanism along the chain track is difficult. In case of replacements of the driving mechanisms of the permanent molds, or in case of any failure, the conveyor has to be stopped. The conveyor line requires a large space due to unutilized areas at the return points, and due to gaps required between the individual driving mechanisms of the permanent molds. Carriers which are used at present are parts of casting units and are always directly coupled with the control mechanism of the casting unit. Similar carriers are for this reason unsuitable for the method and arrangement as used according to this invention.

SUMMARY OF THE INVENTION

It is an object of this invention to provide a method of and an arrangement for casting into permanent molds, which permit the adjustment of the conditions for casting of products of different weights, as well as for products requiring different cooling times of the casting and of the mold.

It is another object of this invention to reduce as much as possible the required floor space, the weight of the arrangement, and consequently the ultimate costs thereof.

It is still another object of the invention to improve working conditions and to permit a high grade of automation.

In the method of handling permanent molds supported on carriers of the casting arrangement and conveyed along a closed track from one technological site to a following one in a forward path and a return path according to this invention, the carriers with permanent molds are conveyed in the forward path intermittently step-by-step from one section to the following section of the same length. At the end of the forward path the carrier with the permanent mold is displaced by a movement in the same direction to a transfer station, where the carrier with the permanent mold is shifted laterally to the level of the return path and subsequently to the start of the return path. Here the carriers with permanent molds are conveyed by the action of a force constantly acting on them in the direction toward the exit end of the return path and to a transfer station where the carriers with permanent molds are individually shifted laterally to the level of the forward path and from here to the start or entry end of the forward path.

In the course of handling of carriers with permanent molds and their transfer from one path to the other, the directional orientation of the carriers remains unchanged.

The step-by-step movement of carriers along the forward path can be accomplished by the intermittent action of a force on a carrier in the zone of transfer to the forward path, whereby adjacent carriers in the forward path are in mutual contact.

In a preferred embodiment, both paths are advantageously of the same length with an equal number of sections of equal length. The first to the twelfth sections are in the forward path and the thirteenth to the twenty-fourth sections are in the return path. In the first and second stations the open permanent mold is checked to ascertain whether it is clean or whether an additional cleaning must be performed; in the third section the sooting of the internal walls of the open permanent mold is carried out; and in the fourth section the permanent mold is closed. In the course of the fifth to the seventh sections the closed permanent mold remains at rest. In the eighth section the closure of the permanent mold is checked. In the ninth section the casting of molten metal into the permanent mold is carried out. If the permanent mold is filled with casting material having a period of solidification shorter than the period provided for casting, the permanent mold is opened in the course of the transfer of the carrier from the ninth to the tenth sections. In the tenth section the permanent mold is opened if the period of solidification of the casting material is longer than the period of the casting section. In the course of the eleventh and twelfth sections the open permanent mold is left at rest. In the course of the thirteenth to the twenty-second sections the open permanent mold is cooled, and in the twenty-third and twenty-fourth sections it is cleaned.

The exchange of carriers can be performed without interruption of the working cycle of the casting arrangement in the neighborhood of the zone for transfer of the carrier from one path to the other.

The arrangement for carrying out the method of handling permanent molds according to this invention comprises carriers of permanent molds, a track for these carriers with a forward path and a return path, a first two-position transfer station for the transfer of carriers from the level of the return path to the level of the forward path, the first position of which is opposite the end of the return path, the second position of which is opposite the start of the forward path, and a second two-position transfer station for the transfer of carriers from the level of the forward path to the level of the return path, the first position of which is opposite the end of the forward path and the second position of which is opposite the end of the return path. The arrangement according to this invention further comprises a step-by-step first drive for the intermittent advance of carriers from the second position of the first transfer station to the first section of the forward path, from one section of the forward path to the following section and from the last section of the forward path to the first position of the second transfer station and another drive for the continuous advance of carriers from the start to the end of the return path and to the first position of the first transfer station. There is furthermore a second drive for shifting a carrier from the first position of the first transfer station to its second position, a third drive for shifting a carrier from the first to the second position of the second transfer station, and a fourth drive for shifting a carrier from the second position of the second transfer station to the start of the return path.

An overhead conveyor track can be provided for the forward path, with carriers suspended thereon by means of travelling rollers.

The carriers advantageously have a length equal to that of the section of the carrier track, the forward path is fully occupied by carriers, which are in mutual contact, and the first drive can be a hydraulic pressure cylinder, stiuated on the free side of the first transfer station at the place of the second position.

An elastic stop may be provided for carriers at the second transfer station, advantageously a hydraulic braking cylinder situated at the free side of the second transfer station at the location of the first position.

The second and third drives can be hydraulic pull cylinders, the second drive being situated within the first transfer station, and the third drive being within the second transfer station. The fourth drive is advantageously a hydraulic pressure cylinder situated at the free side of the second transfer station at the location of its second position.

The continuous drive of carriers from the start to the end of the return path and to the first position of the first transfer station can be accomplished by a roller track with individually driven hydraulic rollers on which the carriers rest.

The minimum number of carriers is equal to the number of sections of the forward path increased by one, the maximum number of carriers is equal to the number of sections of both the forward and return path increased by two.

Each carrier consists advantageously of a first bearing plate and of a second bearing plate with complementary parts of a permanent mold mounted thereon. The first and second bearing plates can be relatively displaced along a guiding means and can be fixed in two positions, (1) a position in which the permanent mold is closed, and (2) a position in which it is opened. The guiding means is anchored in a frame adapted to be displaced along the carrier track.

The frame of the carrier comprises advantageously a first frame plate and a second frame plate, both of which are vertical, mutually parallel and parallel with the direction of advance of the carriers. The ends of the guiding means, which guiding means is represented by four parallel round bars, are fixed to the first frame plate and to the second frame plate and the first bearing plate and second bearing plate can be displaced along this guiding means while remaining parallel with the first and second frame plates. Pressure springs, advantageously Belleville springs, are provided between the first bearing plate and the first frame plate. The second bearing plate is connected with the second frame plate by a two-part hinge strut or toggle joint, adjustable in a vertical plane by a vertical transverse guiding link. This guiding link is mounted slidably in a link plate, determining two stable positions on the guiding means. The central hinge of the toggle joint is positioned in two respective stable positions, on opposite sides of the connection line of both joint connections of the toggle joint, by means of which the toggle joint is connected both to the second bearing plate and to the second frame plate.

The openings for the guiding bars in the first bearing plate advantageously widen toward the surface of the bearing plate, for instance, in the shape of a hyperboloid.

The guiding link can be extended downwards and upwards and provided with actuating elements. Control elements adapted to be raised and tipped, advantageously in the shape of a joint parallelogram, are situated below and above the guiding link on the carrier track.

An ejection pin or plate with an ejection bolt is fixed to the guiding means, a corresponding ejection opening, coaxial with the ejection bolt, being provided in the second bearing plate.

The first frame plate and the second frame plate are provided on their upper ends with four vertical travelling rollers and with horizontal guiding rollers.

An advantage of the method of handling permanent molds supported by carriers according to this invention is that it enables the changing at will of the number of carriers within the abovementioned limits, and thus to cast castings of a higher weight category without the necessity of prolonging the technological cycle.

This advantage is achieved whereby the end of the return path is constantly supplied with carriers with the possibility of increasing or reducing their number within the stipulated limits, whereby the carriers are conveyed toward the end of the return path by means of a force continuously acting thereon in the course of their movement along the whole return path. The casting arrangement for casting into permanent molds according to this invention is designed as a transfer casting arrangement. Its advantages are that the carriers are conveyed along a stable overhead track, which enables casting into permanent molds requiring an automatic ejection of castings. All controls of the carriers are disposed outside these carriers, as the carriers have no proper drive, so that they are simple in design and light. The applied self-locking lever mechanism permits the saving of time when closing and opening the permanent mold supported by the carriers.

A maximum reduction of the length of the casting arrangement according to this invention is achieved by alignment of the carriers in the forward path each close to the other, whereby they are advanced simultaneously by a single stroke of the first drive, which is advantageously a hydraulic pressure cylinder. The movement along the return track, accomplished by hydraulic rollers, enables the changing of the number of carriers in the course of their movement without stopping the casting arrangement. A reduction of the number of carriers causes their quicker movement along the return track and thus enables casting of smaller and thinner castings. The permanent mold must not be cooled below a certain technological temperature, otherwise there is a danger of cracks in the castings. If the number of carriers is increased, their movement along the return track is slowed, which prolongs the cooling time of the permanent mold, enabling the casting of larger castings and of castings having thicker walls.

This flexibility of the casting technology of castings of different size with the casting arrangement according to this invention represents a substantial advantage. The quick opening of permanent molds is of great importance when casting into similar molds. If the solidification period of the casting material is shorter than the period corresponding to the casting section, the opening of the permanent mold is accomplished in the course of the advance of the carriers to the following sections. If the solidification period of the casting material is longer with larger castings, that is, about equal to the period corresponding to the casting section, the permanent mold is opened after advance to the following section. The circulation of the carriers is accomplished along straight lines. The transfer from the forward path to the return path and vice-versa is equally along straight lines perpendicular to the movement along the forward and return path. No arcuate return points and non-utilized gaps between carriers, which are common for conveyor arrangements, are required in the arrangement according to this invention. An advantage of the transfer design of the casting arrangement according to this invention is also a substantial reduction of size of the whole arrangement.

The carrier of the permanent mold according to this invention is of simple design with minor requirements on manufacture and maintenance with a possibility of an easy handling in the course of the working cycle and during adjustment. The main advantage of the carrier is that it requires no individual drive for opening and closing, that is, this operation is controlled from outside the carrier, from the casting arrangement. The prime costs of the carriers are therefore rather low. From the point of view of energy, the method of control of the guiding link for opening and closing the permanent mold is not demanding. An advantage of the carrier is that is can be advanced both step-by-step, as it is provided with suspension and guiding means and can equally move continuously by means of frame plates. The first bearing plate of the carrier supported by hyperboloidal openings on guiding means enables by means of Belleville springs a reduction of pressure molds and enables by a motion of the first bearing plate in a direction opposite to the direction of advance a tilting of the guiding link to a self-locking position of the lever mechanism for closing the permanent mold.

The casting with the casting arrangement according to this invention represents a qualitative progress in the field of productivity of labor and a substantial improvement of working conditions, as it does not require the presence of an attendant on a working site where radiant heat abounds and where acetylene soot and other harmful substances are present. The whole system of the casting arrangement mechanizes and automates all decisive working operations which have been previously carried out by attendants. This solution entirely eliminates any negative or subjective influence of the attendant on the whole technological process, and thus also on economic and qualitative indices, for instance of scrap products, of the utilization of material, and of the lifetime of permanent molds. The design of the casting arrangement according to this invention eliminates the necessity of cooling permanent molds with water. The heat conditions of permanent molds in the casting arrangement are determined by the number of applied molds, fixed in carriers, so that no expensive cooling system is required and the permanent molds are not exposed to sudden changes of temperature within a short time interval, which substantially influences a prolongation of the lifetime of permanent molds.

The arrangement according to this invention also compensates for the reduction in the number of attendants. It requires only three attendants in a working shift, whereas in presently operating leading casting arrangements five attendants are needed in a working shift. Due to the exact character of the course of the whole technological process, it is possible by application of the casting arrangement according to this invention to reduce the weight of the castings by fifteen to twenty percent as compared to castings made on known leading casting arrangements. The casting arrangement according to this invention surpasses by its parameters the state of the art of existing casting techniques. The costs of the arrangement according to this invention are about one-third the costs of leading casting arrangements using sand molds.

The casting arrangement according to this invention operates with periods of 7 seconds for one section. For a most recent casting arrangement operating with a system of frameless sand forming, which represents the best practice of this type, the manufacture specifies the shortest time of a cycle as 10 seconds. The casting arrangement according to this invention shows, against such leading prior art arrangement, a capacity of casts that is higher by 43%. The arrangement of this invention requires a substantially smaller floor space, about one-third thereof, so that about two-thirds of the construction costs are saved. The casting according to this invention cannot be compared with classical sand casting, and resembles more engineering production, and can therefore be applied without difficulties advantageously in each establishment for mechanical engineering, where similar castings are required and where there is no experience in casting.

BRIEF DESCRIPTION OF THE DRAWINGS

The accompanying drawings illustrate diagrammatically an exemplary embodiment of an arrangement for carrying out the method of the present invention, wherein.

DESCRIPTION OF PREFERRED EMBODIMENT

Figure 1:
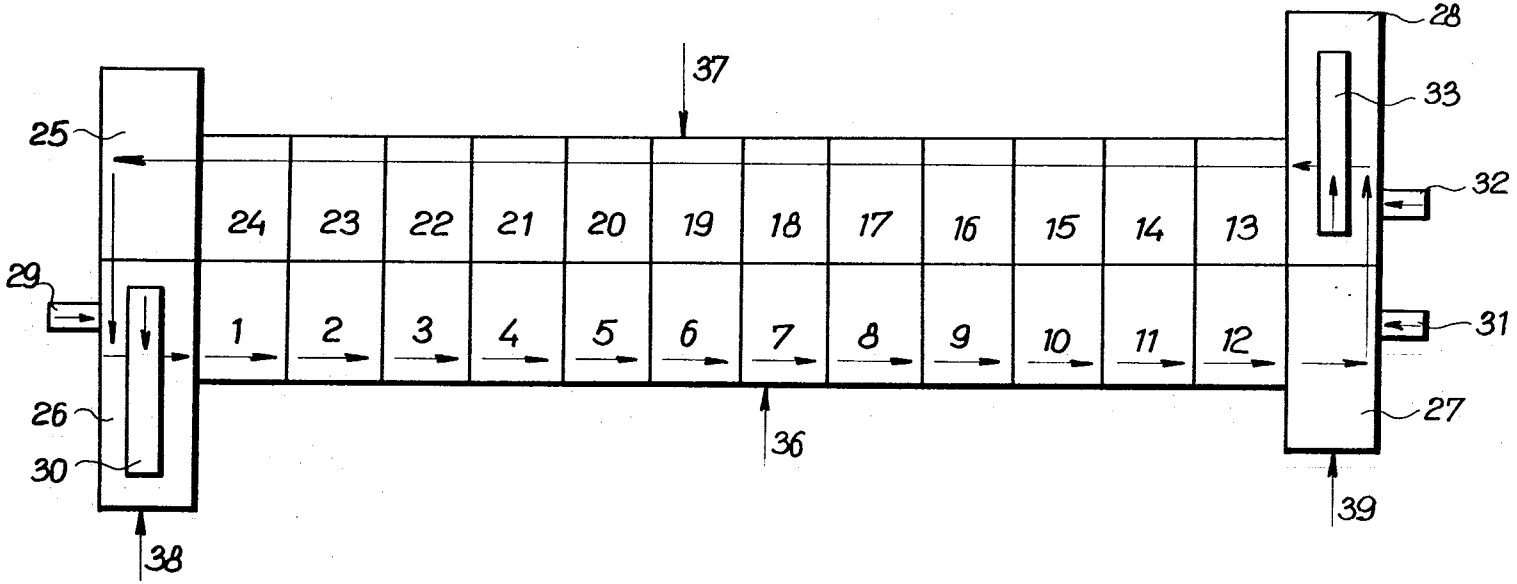
FIG. 1 is a diagrammatic top view of the casting arrangement.
Figure 2:
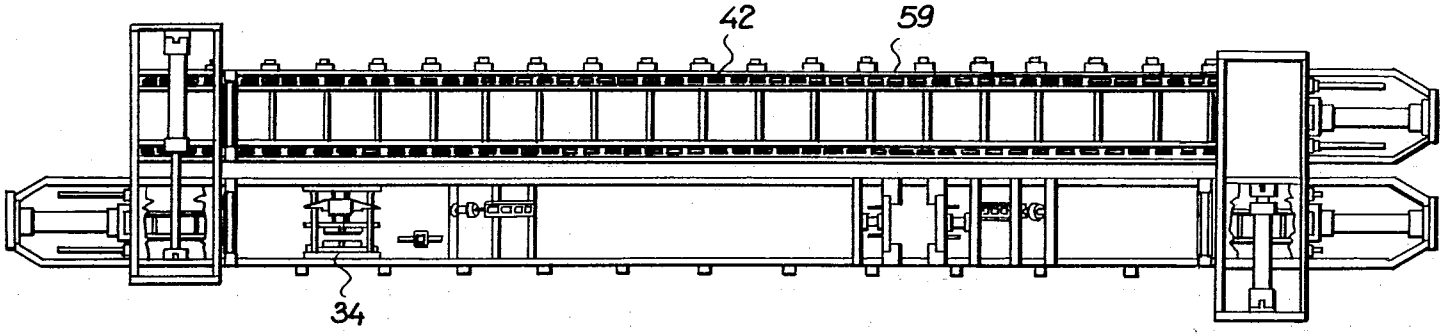
FIG. 2 is a top view of the arrangement, showing some details thereof.

Turning first to FIGS. 1 and 2, the casting arrangement comprises a forward path 36 with a first section 1 up to a twelfth section 12 and a return path 37 with a thirteenth section 13 up to a twenty-fourth section 24. A first transfer station 38 and a second transfer station 39 are the connecting ends and starts of both paths 36 and 37, respectively. The forward path 36 consists of sections where the technological operations proper on individual carriers 34, each of which supports a permanent mold 35, are carried out while advancing from one section to the next. The sections start with the first section 1 and the second section 2, serving for checking whether the open permanent molds 35 are clean and for their eventual final cleaning. The following third section 3 is a sooting section. The fourth section 4 is a closing section. The following, fifth section 5, the sixth section 6, and the seventh section 7 are technologically necessary free sections. The eighth section 8 serves for checking the closure of the permanent mold 35, the ninth section 9 is a casting section. The tenth section 10 is the opening section. The following, eleventh section 11 and the twelfth section 12 are technologically necessary free sections.

In front of the start of the forward path 36, the second position 26 of the first transfer station 38 is provided, and the first position 27 of the second transfer station 39 is behind the end of the forward path 36. The return path 37 is composed of the thirteenth section 13 up to the twenty-fourth section 24. The number of sections of the return path 37 starting with the thirteenth section 13 up to the twenty-second section 22 are technologically necessary free sections. The twenty-third section 23 and the twenty-fourth section 24 are assigned for cleaning the mold 35. The second position 28 of the second transfer station 39 is situated opposite to the start of the return path 37, the first position 25 of the first transfer station 38 is situated opposite to the end of the return path 37. Possible exchanges of carriers 34 can be accomplished near the first position 25 of the first transfer station 38 and/or near the second position 28 of the second transfer station 39 in the course of operation of the whole arrangement. The second drive 30 cares for transfer of the carrier 34 between the first position 25 and the second position 26 of the first transfer station 38, the first drive 29 cares for the advance of carriers 34 for one working stroke in the forward strand at a simultaneous action of the elastic stop 31.

The transfer of the carrier 34 from the first position 27 of the second transfer station 39 to the second position 28 of the second transfer station 39 is accomplished by the third drive 33. The fourth drive 32 cares for transfer of the carrier 34 from the second position 28 of the second transfer station 39 to the thirteenth section 13 of the return path 37. The individual sections of the return track 37, that is, the thirteenth section 13 up to the twenty-fourth section 24 are represented by individual hydraulically-driven roller tracks causing the carriers 34 to be continuously advanced toward the end of the return path 37 and to the first position 25 of the first transfer station 38. This arrangement provides that the return path 37 of the casting arrangement need not be occupied in all sections, so that if there is a smaller number of carriers at this path 37, the carriers 34 reach the end of the return path 37 quicker. A condition for correct operation is, of course, a minimum number of carriers 34, that is, a fully-occupied forward path 36 from the first section 1 up to the twelfth section 12 and at least one carrier 34 on the return path 37 which reaches the first position 25 of the first transfer station 38 from the return path 37 and thus enables a repetition of the whole cycle.

The maximum number of carriers 34 in this case is twenty-six, i.e. a fully-occupied forward path 36 from the first section 1 to the twelfth section 12, a fully-occupied return path 37 from the thirteenth section 13 to the twenty-fourth section 24 and always one carrier 34 in the first transfer station 38 and in the second transfer station 39.

Figure 3:
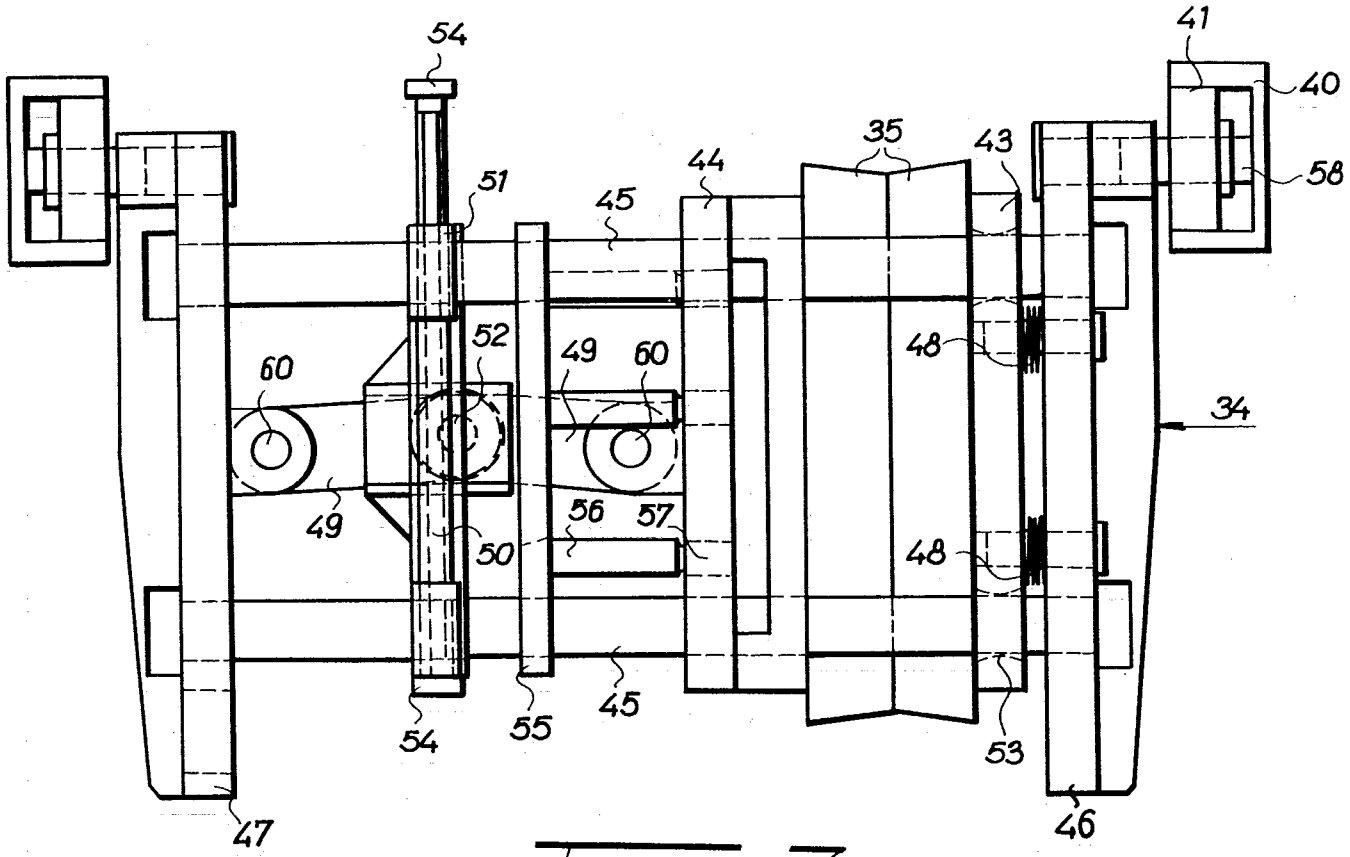
FIG. 3 is an elevation of a carrier with a closed permanent mold in a self-locking position.
Figure 4:
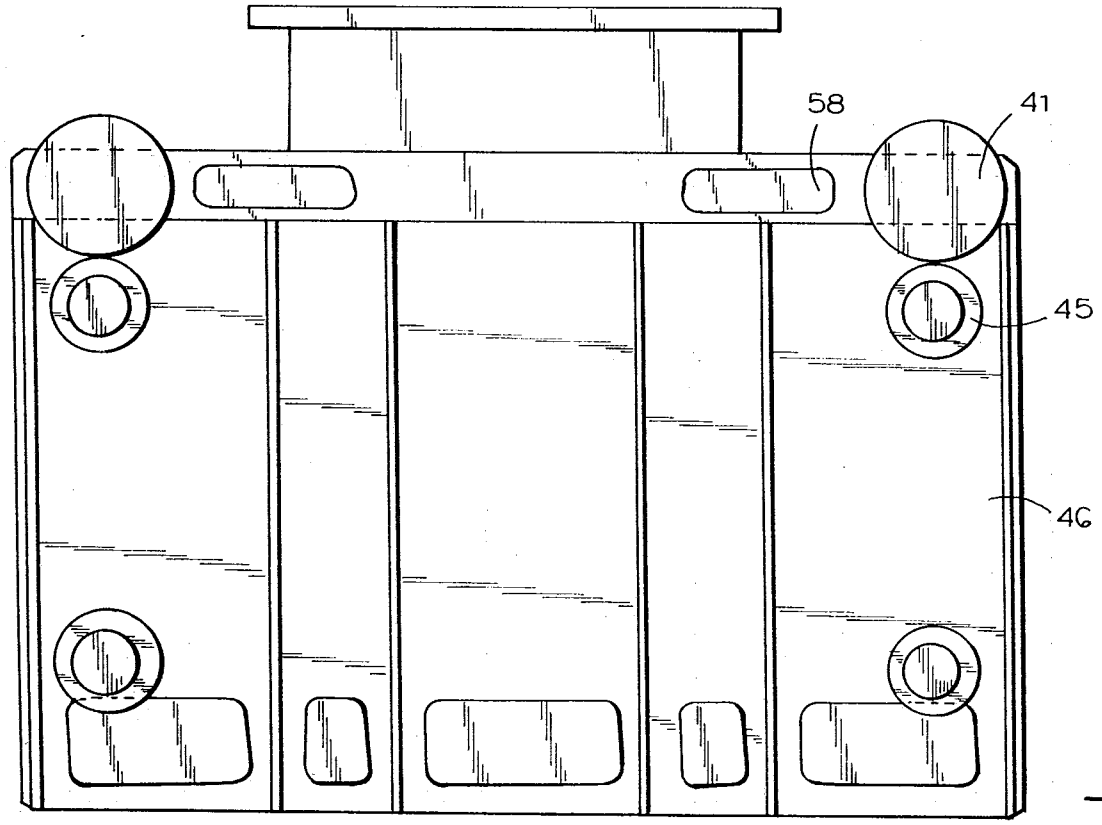
FIG. 4 is a side view of the carrier.

Turning to FIGS. 3 and 4, the carrier 34 comprises a first bearing plate 43 and a second bearing plate 44 with complementary parts of the permanent mold 35 fixed on these plates. The first bearing plate 43 and the second bearing plate 44 can be relatively displaced along a guiding means 45 and can be fixed in two positions, in a position where the permanent mold 35 is closed, and in a position where the permanent mold is open. The guiding means 45 is anchored in a frame adapted to be advanced along the track of the carriers 34. The frame of the carrier 34 comprises a first frame plate 46 and a second frame plate 47 which are both vertical, mutually parallel, and parallel with the direction of advance of the carriers 34 along the forward and return paths. The respective extremeties of the guiding means 45, represented by four parallel round bars, are anchored in the first frame plate 46 and in the second frame plate 47 perpendicularly to the surface of these plates. The first bearing plate 43 and the second bearing plate 44 are supported in sliding fashion by the guiding means 45 while remaining parallel with the first frame plate 46 and with the second frame plate 47. Pressure springs 48, advantageously Belleville springs, are provided between the first bearing plate 43 and the first frame plate 46. The second bearing plate 44 is connected with the second frame plate 47 by a two-part toggle joint or hinge strut 49 adjustable in a vertical plane by means of a vertical transverse guiding link 50. The guiding link 50 is mounted slidably in a link plate 51, determining two stable positions. The central hinge 52 of the toggle joint 49 is in both stable positions on opposite sides of the connection line of both joint supports 60 of the toggle joint 49, by means of which the toggle joint 49 is joint connected both to the second bearing plate 44 and to the second frame plate 47. The openings 53 in the first bearing plate 43 for the bars of the guiding 45 widen toward the surface of the guiding plate 43, for instance, in the shape of a hyperboloid.

The guiding link 50 is extended downwards and upwards (FIG. 3) and is provided with an actuating element 54 at each end. Control elements not shown adapted to be raised and tipped, advantageously of the shape of a joint parallelogram, are situated below and above the lower and upper ends, respectively, guiding link 50 on the carrier track. An ejection plate 55 with ejection bolts or pins 56 is fixed to the guiding means 45, corresponding ejection openings 57, coaxial with the respective ejection bolt 56 are provided in the second bearing plate 44. The first frame plate 46 and the second frame plate 47 are provided on their upper ends with four vertical travelling rollers 41 and with horizontal guiding rollers 58.

The whole electronically controlled technological cycle with hydraulic drives lasts 7 seconds. The individual technological operations are performed in prior determined sections. After the carrier 34 has been transferred from the return path 37 to the forward path 36 by means of the second drive 30, the carrier 34 is urged by the first drive 29 to the forward path 36, where it is advanced step-by-step from the first section 1 up to the twelfth section 12 of the forward path and to the first position 27 of the second transfer station 39, whereby at each stroke of the first drive 29 a new carrier 34 is joining the earlier supplied. In the first section 1 and in the second section 2 the open permanent mold 35 is checked as to its cleanliness and eventually finally cleaned. Simultaneously, the sooting of the open permanent mold 35 takes place in the third section 3, i.e., the internal surface of the permanent mold 35 is provided with a coat of acetylene soot. In the fourth section 4 the permanent mold 35, supported by the carrier 34, is closed. In technological free sections 5, 6, and 7, which are necessary for final cooling of the permanent mold 35, no technological operations are performed. In the eighth section 8 the closure of the permanent mold 35 is checked.

If the permanent mold 35 is correctly closed, a signal for dosing the casting material from an automatic oven is released. As it is possible to cast on the casting arrangement according to this invention castings of different weight categories, there are, after filling of the permanent molds 35 with the casting material, two possibilities: (1) If the permanent mold 35 is filled with casting section (lower weight category), the mold 35 is opened automatically in the course of its transfer from the ninth section 9 to the tenth section 10 and the casting is automatically ejected; (2) In the case of castings having alonger solidification time, i.e., a time interval approximately equal to the time interval limited for casting (higher weight category of castings), the permanent mold 35 is opened in the tenth section 10 and the casting is automatically ejected.

By way of the technologically idle eleventh section 11 and the twelfth section 12, the carriers 34 are advanced to the first position 27 of the second transfer station 39. In case that it has been found, when checking the closure of the permanent mold 35, that it is not properly closed, the casting is prevented and the carrier 34 passes the ninth section 9 without pouring the casting material and the permanent mold 35 is opened in the tenth section 10. In the course of passage through the eleventh section 11 and the twelfth section 12 no technological operation is performed, and the mold 35 finally reaches the first position 27 of the second transfer station 39. The carrier 34 is here transferred by the third drive 33 to the second position 28 of the second transfer station 39 and subsequently by the fourth drive 32 to the thirteenth section 13 of the return path 37 where it is conveyed on hydraulic rollers 42 of the roller track 39, which act on the carrier 34 with a continuously acting force to the twenty-third section 23 and twenty-fourth section 24, where the open permanent mold 35 is cleaned.

The extent to which the return path 37 of the casting arrangement is occupied is determined by the size of the castings and by the time interval required for cooling the permanent mold 35. During the time, where technological operations performed in the first section 1 up to the twelfth section 12 of the forward path, one or more carriers 34 are conveyed in the return path 34 on hydraulic rollers 42 toward the first position 25 of the first transfer station 38 which is a starting place for a following cycle. The second drive 30 subsequently transfers the carrier 34 from the first position 25 of the first transfer station 38 to its second position 26. Simultaneously the third drive 33 returns from the second position 28 of the second transfer station 39 to its first position 27 and the whole cycle is repeated.

It is possible to prepare with the method and arrangement according to this invention all castings, suitable for casting in permanent molds, from gray cast iron, aluminum, and other metallic and non-metallic casting material by gravitation or pressure cast- ing.

Although the invention is illustrated and described with reference to a single preferred embodiment thereof, it is to be expressly understood that it is in no way limited to the dislosure of such preferred embodiment but is capable of numerous modifications within the scope of the appended claims.

We claim:

1. An arrangement for handling permanent molds, comprising a plurality of carriers of permanent molds, a closed track for said carriers, this track comprising a forward path and a return path, each of said paths having a plurality of sections including at least first and last sections, a first transfer station having a first positon and a second position, said first transfer station being adapted to transfer carriers between the return path and the forward path, the first position of the first transfer station being opposite the last section of the return path, and the second positon of the first transfer station being opposite the first section of the forward path, a second transfer station having a first position and a second position, said second transfer station being adapted for transfer of carriers between the forward path and the return path, the first position of the second transfer station being opposite the last section of the forward path, the second position of the second transfer station being opposite the first section of the return path, an intermittent first drive means for the step-by-step advance of carriers from the second position of the first transfer station to the first section and thence to the last section of the forward path, a continuous drive means for imparting to the carriers a continuous movement from the first section of the return path to its last section and to the first position of the first transfer station for the advance of a carrier from section-to-section of the forward path and from the last section of the forward path to the first position of the second transfer station, a second drive means for the transfer of a carrier from the first to the second position of the first transfer station, a third drive means for the transfer of a carrier from the first to the second position of the second transfer station, and a fourth drive means for the transfer of carrier from the second position of the second transfer station to the first section of the return path.

2. An arrangement as claimed in claim 1, wherein an overhead conveyor track is provided for the forward path and the carriers are suspended thereon by travelling rollers.

3. An arrangement as claimed in claim 1, wherein the forward path comprises a number of equal sections, the length of these sections is equal to the length of the carriers, the carriers are in mutual contact, and the first drive means is a hydraulic pressure cylinder situated at the first transfer station at the place of its second position.

4. An arrangement as claimed in claim 3, comprising an elastic stop for carriers in the second transfer station, the second transfer station having a free side, the stop being situated on the free side of the second transfer station at the place of its first position.

5. An arrangement as claimed in claim 1, wherein both the second and third drive means are hydraulic pull cylinders, the second drive means is situated in the first transfer station, and the third drive means is in the second transfer station.

6. An arrangement as claimed in claim 1, wherein the fourth drive means is a hydraulic pressure cylinder situated at the second transfer station at the place of its second position.

7. An arrangement as claimed in claim 1, wherein the drive means for a continuous movement of carriers from the start to the end of the return path and to the first position of the first transfer station is accomplished by a roller track comprising individually drive rollers supporting the carriers.

8. An arrangement as claimed in claim 1, wherein the smallest number of carriers is equal to the number of sections of the forward path increased by one, and the maximum number of carriers is equal to the sum of the sections in both the forward and return paths increased by two.

9. An arrangement as claimed in claim 1, wherein the carrier comprises a frame, a first bearing plate and a second bearing plate, both said bearing plates supporting complementary parts of a permanent mold, both bearing plates having opposite parallel broad surfaces, guiding means for said bearing plates supported by said frame, the first and second bearing plates being adapted to be mutually shifted along said guiding means between two predetermined positions, at a first one of said positions the permanent mold being open, and at a second position the mold being closed.

10. An arrangement as claimed in claim 9, wherein the guiding means for the bearing plates are guiding bars, the first bearing plate is provided with openings for the guiding bars, said openings widening toward both opposite parallel broad surfaces of the first bearing plate.

11. An arrangement as claimed in claim 9, comprising an ejection plate fixed to said guiding means, an ejection bolt supported by said ejection plate, and an ejection opening provided in the second bearing plate, said ejection opening being coaxial with said ejection bolt.

12. An arrangement as claimed in claim 9, wherein the frame of the carrier is provided with four vertical travelling rollers and with horizontal guiding rollers.

13. An arrangement as claimed in claim 9, wherein the frame comprises a first frame plate and a second frame plate, both these frame plates being vertical, mutually parallel and parallel with the direction of advance of carriers along both the forward and return paths, the guiding means being four parallel round bars fixed to the first and second frame plates, respectively, said bars supporting in sliding fashion the first and second bearing plates, pressure springs provided between the first bearing plate and the first frame plate, a two-part toggle joint provided between the second bearing plate and the second frame plate, one part of said toggle joint being connected to the second frame plate, the other part thereof being joint connected to the second bearing plate, this toggle joint being adapted to be displaced in a vertical plane, a vertical transverse guiding link connected to the central hinge of the toggle joint, a link plate fixed to the frame of the carrier, the guiding link being supported in sliding fashion by said link plate between two determined positions in which positions the central hinge of the toggle joint is situated on different sides of a connection line of both joint connections of the toggle joint with the second bearing plate and the second frame plate, respectively.

14. An arrangement as claimed in claim 13, wherein the transverse guiding link is extended upwards and downwards and provided on its ends with actuating elements.

* * * * *